US006981909B2

(12) United States Patent
Burgess

(10) Patent No.: US 6,981,909 B2
(45) Date of Patent: Jan. 3, 2006

(54) METHOD FOR CONDITIONING SUPERABRASIVE TOOLS

(75) Inventor: Gregory Mark Burgess, Maineville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/861,153

(22) Filed: Jun. 4, 2004

(65) Prior Publication Data

US 2005/0272349 A1 Dec. 8, 2005

(51) Int. Cl.
*B24B 1/00* (2006.01)

(52) U.S. Cl. ..... 451/56; 451/72; 125/11.01

(58) Field of Classification Search ..... 451/21, 451/56, 72, 443, 444, 67, 68, 70, 324, 164, 451/173; 125/11.01–11.23

See application file for complete search history.

(56) References Cited

U.S. PATENT DOCUMENTS

| | | | | |
|---|---|---|---|---|
| 2,947,302 | A * | 8/1960 | Patterson | 125/11.13 |
| 4,151,684 | A * | 5/1979 | Wada et al. | 125/11.01 |
| 4,286,568 | A | 9/1981 | Komandure | |
| 4,555,873 | A * | 12/1985 | Smith | 451/21 |
| 6,248,003 | B1 * | 6/2001 | Hoshiya | 451/56 |

* cited by examiner

*Primary Examiner*—Dung Van Nguyen
(74) *Attorney, Agent, or Firm*—Adams Evans P.A.; V.G. Ramaswamy

(57) ABSTRACT

A method for conditioning a superabrasive grinding tool having a cutting surface includes truing the grinding tool by moving the cutting surface against a truing device to shape the cutting surface into a preselected profile, and subsequently moving the cutting surface against a sacrificial member so that the binder of the grinding tool is worn down, creating a plurality of spaces between the superabrasive particles. The spaces provide a flowpath for coolant and cutting chips during a subsequent machining process on a workpiece. Localized overheating or "burning" of the workpiece is thus avoided.

17 Claims, 3 Drawing Sheets

METHOD FOR CONDITIONING SUPERABRASIVE TOOLS

BACKGROUND OF THE INVENTION

This invention relates generally to a method for conditioning abrasive tools and more particularly to a method of conditioning superabrasive wheels.

Precision grinding is a known process used to form machined parts by rotating or otherwise moving an abrasive tool (e.g. a grinding wheel) at a high surface speed and feeding it into a workpiece. Common abrasive tools include aluminum oxide grit dispersed in a binder, for example. "Superabrasives" such as diamond or cubic boron nitride (CBN) have also been developed, which are much longer wearing than conventional abrasives and allow higher feed rates in hard materials.

Strict metallography requirements (e.g. low cycle fatigue and residual stress) have hampered or even prohibited the use of superabrasive grinding wheels for certain gas turbine engine components, because of the adverse post-dress condition of the superabrasive grinding wheel. After dressing or wheel truing the binder material that holds the superabrasive particles of the superabrasive grinding wheel fills the spaces between the superabrasive crystals, inhibiting good coolant and chip flow. This condition causes part material "burning" (i.e. localized overheating) to occur until the bond material erodes sufficiently to allow space for coolant and chips. This condition is especially sensitive to softer materials such as stainless steel (e.g. AM355 and A286 alloys). Prior art methods exist for "opening" the grinding wheel surface to expose the abrasive particles, however they are typically manual methods which are difficult to perform in a repeatable manner.

Accordingly, there is a need for a simple and repeatable method of conditioning a superabrasive tool to avoid localized workpiece overheating.

BRIEF SUMMARY OF THE INVENTION

The above-mentioned need is met by the present invention, which according to one aspect provides a method for conditioning a grinding tool which includes a plurality of superabrasive particles dispersed in an abradable binder and a cutting surface. The grinding tool is trued by moving the cutting surface against a truing device such that the cutting surface of the grinding tool is shaped into a preselected profile. The cutting surface is then moved against a sacrificial member so that the binder is worn down, thereby creating a plurality of spaces between the superabrasive particles.

According to another aspect of the invention, a method of conditioning a grinding wheel includes the steps of: providing a grinding wheel comprising a plurality of superabrasive particles dispersed in an abradable binder, the grinding wheel including at least one cutting surface for contacting a workpiece made of a selected first material; truing the grinding tool by rotating the grinding wheel while moving the cutting surface against a truing device such that the cutting surface is shaped into a preselected profile; and rotating the grinding wheel while moving the cutting surface against a sacrificial member made from a second selected material similar to the first material so that the binder is worn down, thereby creating a plurality of spaces between the superabrasive particles at the cutting surface.

According to another aspect of the invention, a method of forming a feature in a workpiece includes: providing a grinding wheel comprising a plurality of superabrasive particles dispersed in an abradable binder, the grinding wheel including at least one cutting surface for contacting a workpiece made of a selected first material; truing the grinding wheel by rotating the grinding wheel while moving the cutting surface against a truing device such that the cutting surface is shaped into a preselected profile; and conditioning the grinding wheel by rotating the grinding wheel while moving the cutting surface against a sacrificial member made from a second selected material similar to the first selected material so that the binder is worn down, thereby creating a plurality of spaces between the superabrasive particles at the cutting surface. The grinding wheel is then rotated while moving the cutting surface against a workpiece such that a feature is formed in the workpiece.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
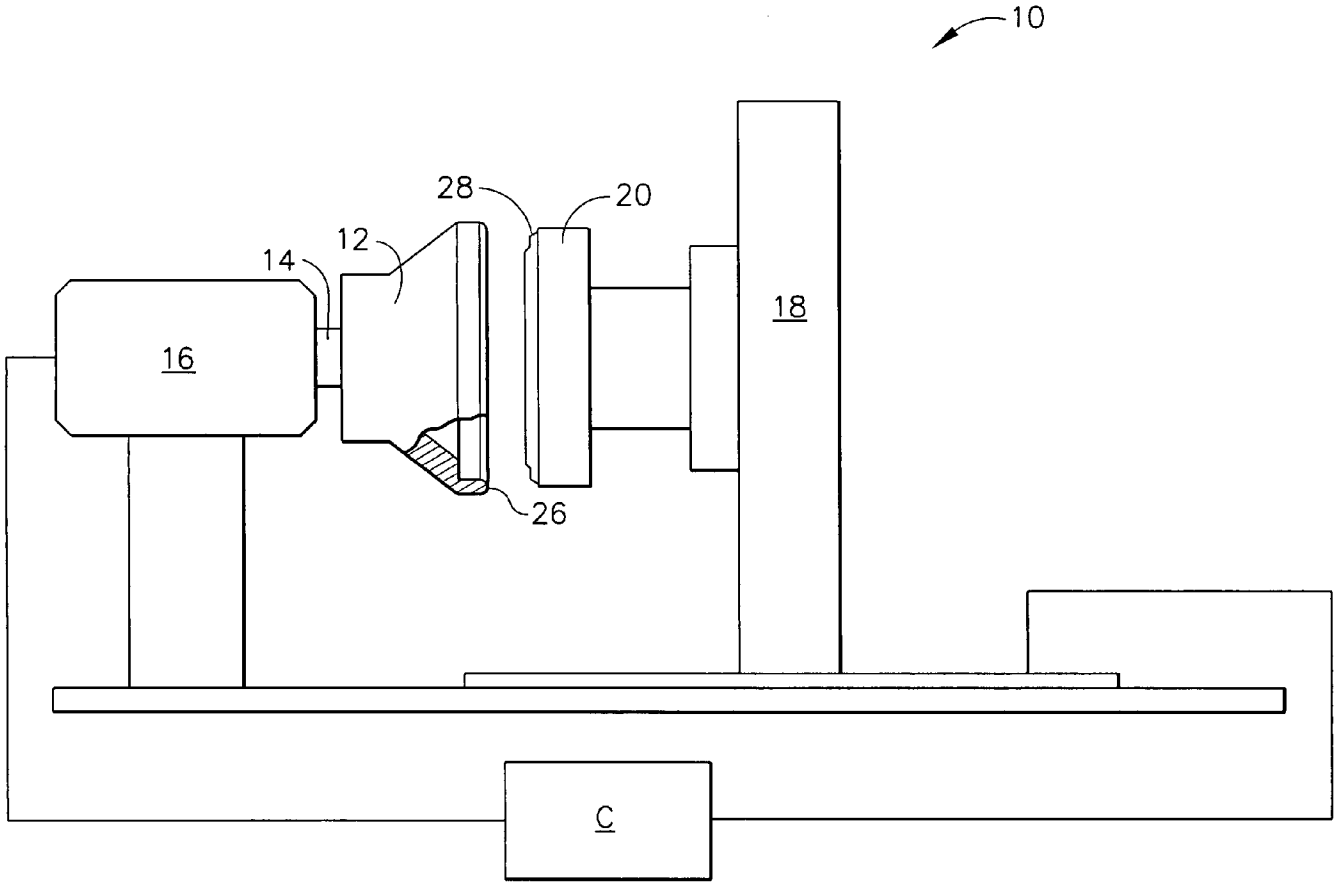
FIG. 1 is a schematic side view of a grinding apparatus including a grinding wheel being dressed with a truing device.

Referring to the drawings wherein identical reference numerals denote the same elements throughout the various views, FIG. 1 illustrates an exemplary grinding apparatus 10 including a grinding wheel 12 mounted to the spindle 14 of a known type of grinding machine 16. The grinding machine 16 rotates the grinding wheel 12 at a selected high speed. The grinding apparatus 10 also provides a holding fixture 18 for holding a truing device 20 or a workpiece (not shown). The grinding apparatus 10 includes known means for and selectively moving the holding fixture relative to engage the grinding wheel 12, for example along mutually perpendicular "X", "Y", and "Z" axes. The entire grinding apparatus 10 may be controlled by a numerical controller or computer of a known type, illustrated schematically at "C". Although the present invention is described herein with reference to a grinding wheel, it is noted that it may also be used with other types of abrasive tools.

Figure 4:
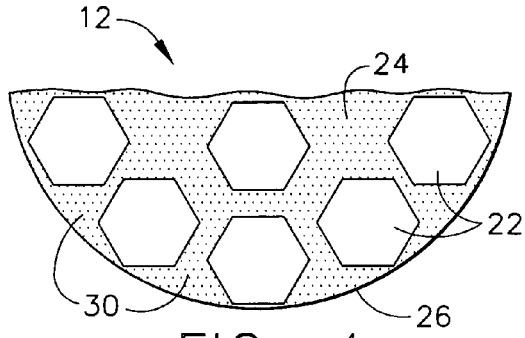
FIG. 4 is an enlarged view of a portion of a grinding wheel after a truing operation.

As shown in FIG. 4, the grinding wheel 12 is composed of a plurality of superabrasive particles 22, for example diamond or cubic boron nitride (CBN), dispersed in an abradable binder 24. In the illustrated example, the binder 24 is a vitrified ceramic material. The grinding wheel 12 includes a cutting surface 26 which is formed in the profile of the surface feature to be manufactured.

FIG. 1 illustrates the process of truing the grinding wheel 12. As used herein the term "truing" is used to mean the process of forming the cutting surface 26 to the desired profile. This is done by rotating the grinding wheel 12 and moving the truing device 20 into contact with the cutting surface 26, so that cutting surface 26 is shaped into the desired profile. As used herein, the term "shaped" refers generally to the cutting action of the truing device 20 on the cutting surface, and not to any specific wear mechanism. The truing device 20 is a tool having a working surface 28 which is formed in the desired shape (i.e. the positive profile to be formed in a workpiece) and which is harder than the cutting surface 26 of the grinding wheel 12. For example, if the superabrasive particles are CBN, the truing device 20 may have a diamond working surface 28.

FIG. 4 illustrates the cutting surface 26 of the grinding wheel 12 after the truing process. As a result of this process, the cutting surface 26 matches with the desired profile; however the superabrasive particles 22 are not exposed and the binder 24 fills the spaces 30 between the superabrasive particles 22. If the grinding wheel 12 were used in this condition, there would be no space for coolant flow or chip transport between the cutting surface 26 and the workpiece. Thus, "burning" or localized overheating of the workpiece would occur until the binder 24 was sufficiently worn away to expose the spaces 30. This practice is not acceptable for components which have strict heat treatment or crystallographic requirements, such as the rotating components of gas turbine engines.

Figure 2:
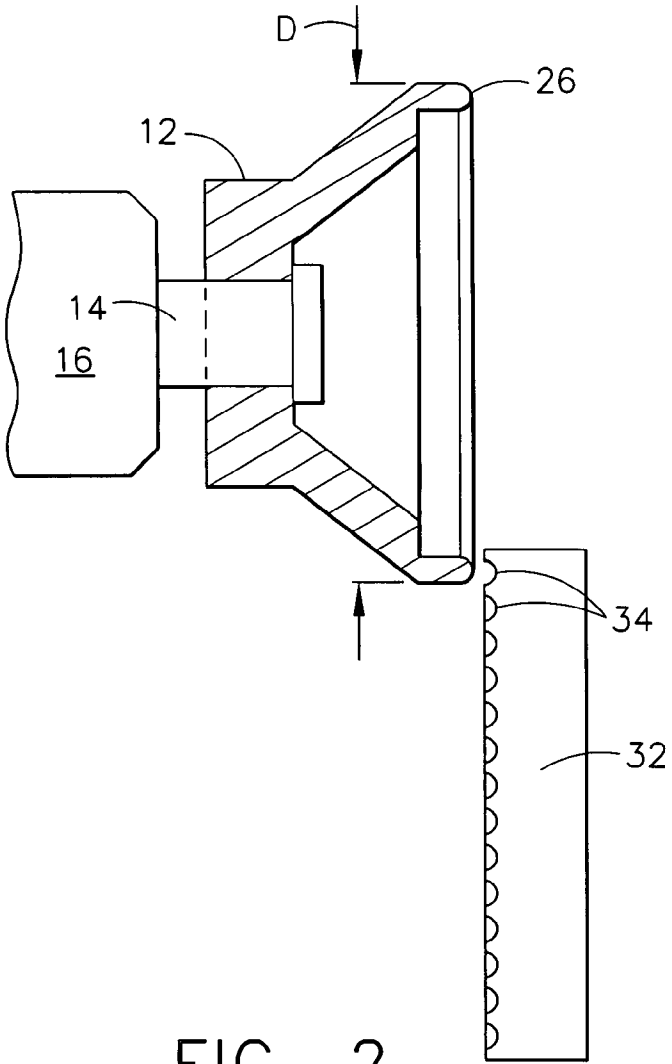
FIG. 2 is a schematic cross-sectional view of a grinding wheel undergoing a conditioning process.
Figure 6:
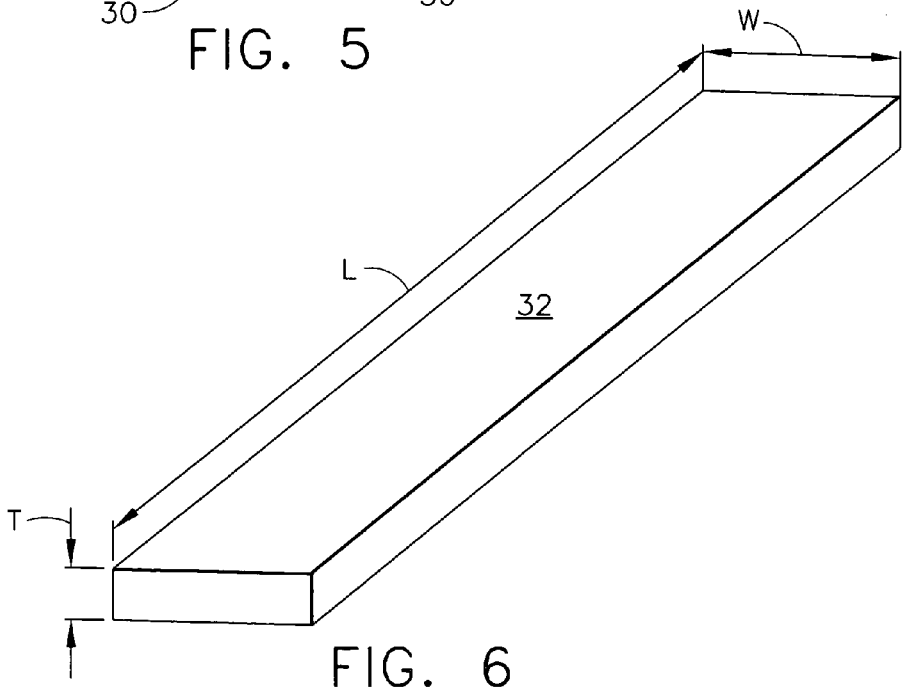
FIG. 6 is a schematic perspective view of an exemplary sacrificial member.

FIG. 2 illustrates an exemplary conditioning process carried out according to the present invention. A sacrificial member 32 is provided for this purpose. The sacrificial member 32 is constructed of a similar material to and has a dimensions similar to the anticipated workpiece, in order to most closely simulate the actual grinding conditions. In the illustrated example, the member 32 (see FIG. 6) is made from stainless steel, for example an AM355 or A286 alloy, and has a length "L" of about 15.2 cm (6 in.), a width "W" of about 2.5 cm (1 in.), and a thickness "T" of about 0.95 cm (0.375 in.). Successive cuts 34 are made into the sacrificial member 32 until no signs of "burning" remain in the sacrificial member by rotating the grinding wheel 12 and bringing the cutting surface into contact with the sacrificial member. These cuts 34 simulate the teeth or slots to be made in the actual workpiece. The following parameters are exemplary, based on a grinding wheel 12 having a diameter "D" of about 15.2 cm (6 in.) to about 17.8 cm (7 in.): grinding wheel speed about 3000 to about 3500 RPM; and feed rate into the sacrificial member 32 of about 5.1 mm/min. (0.2 in./min.) at the start of the process, increasing to about 10.1 mm/min. (0.4 in./min.) or about 12.7 mm/min. (0.5 in./min.) at the finish. In the illustrated example a total of about 15 cuts are sufficient for this process. By using a known type of controller C (see FIG. 1), this conditioning process can be automated. That is, the grinding wheel 12 is automatically rotated at the proper speed and positioned at a preselected alignment relative to said sacrificial member 32. The cutting surface 26 and the sacrificial member 32 are brought into contact to form the first cut 34 and then separated. These steps are then repeated to form a second cut 34, and so forth until the conditioning process is complete. The material and dimensions of the sacrificial member 32 and the conditioning parameters are chosen to simulate the actual grinding process, but also to promote localized overheating or "burning" of the sacrificial member 32. For example, the thickness T of the sacrificial member 32 is chosen so that the chip path is at least as great of that of the workpiece. Therefore, once "burning" ceases in the sacrificial member 32, the workpiece may be machined with high confidence that no workpiece "burning" will occur.

Figure 5:
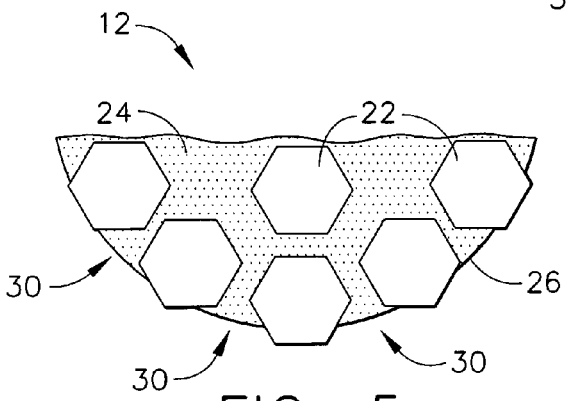
FIG. 5 is an enlarged view of a portion of a grinding wheel after a subsequent conditioning process.

FIG. 5 illustrates the grinding wheel after the conditioning process. During this process, the binder 24 is naturally worn away at a faster rate than the much harder superabrasive particles 22, leaving the superabrasive particles 22 at the cutting surface 26 exposed with open spaces 30 between them. These spaces 30 provide a flow path for coolant and cutting chips between the cutting surface 26 and the workpiece.

Figure 3:
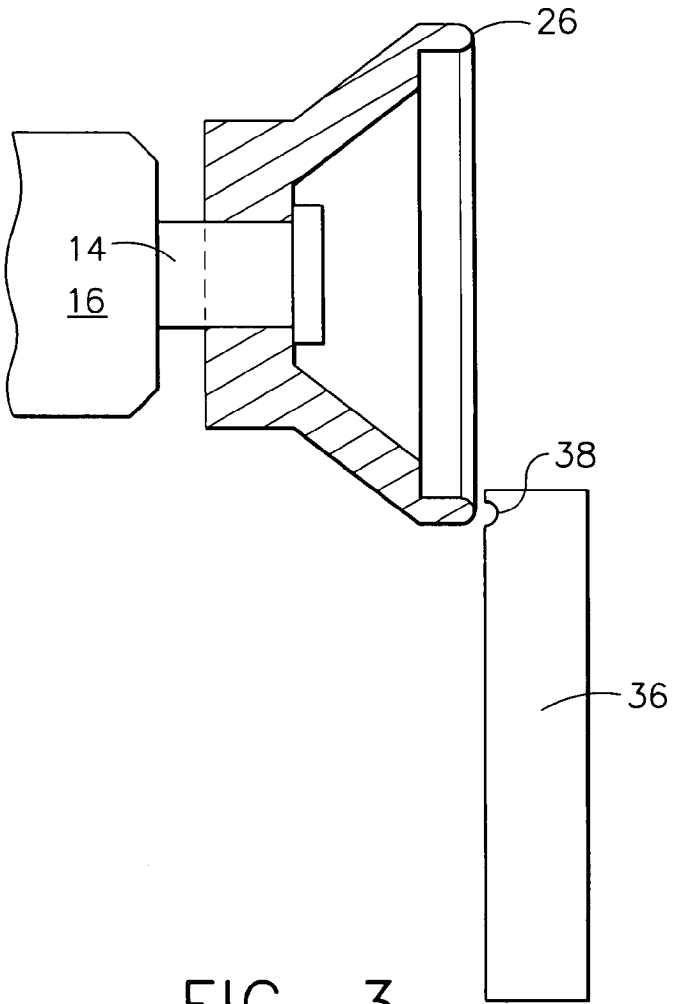
FIG. 3 is a schematic cross-sectional view of a grinding wheel and a workpiece undergoing a grinding process.

After the conditioning step described above is completed, the grinding wheel 12 is ready for use. As shown in FIG. 3, the sacrificial member 32 is removed from the holding fixture 18 and a workpiece 36 is mounted in the holding fixture 18. The grinding wheel 12 is then rotated and the cutting surface 26 is brought into contact with workpiece 36 to form the desired features, shown by the representative cut 38. There is plenty of space for coolant flow and chip transport between the cutting surface 26 and the workpiece 36. Thus, "burning" or localized overheating of the workpiece 36 is avoided. This method offers significant gains over prior art processes. In particular, it allows the use of superabrasives in applications where it was previously prohibited. The substitution of superabrasives for conventional abrasives substantially reduces the labor, cost, material waste, and environmental impact of the grinding process.

The foregoing has described a method for conditioning a superabrasive grinding tool. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A method for conditioning a grinding tool, comprising the steps of:

providing a grinding tool comprising a plurality of superabrasive particles dispersed in an abradable binder, said grinding tool having a cutting surface;

truing said grinding tool by moving said cutting surface against a truing device such that said cutting surface of said grinding tool is shaped into a preselected profile;

contacting said cutting surface against a sacrificial member to form a first cut in said sacrificial member;

separating said cutting surface and said sacrificial member; and repeating said steps of contacting said cutting surface and said member, and separating said cuffing surface and said sacrificial member, to form subsequent cuts in said sacrificial member, until a plurality of spaces are created between said superabrasive particles.

2. The method of claim 1 wherein said superabrasive particles comprise cubic boron nitride.

3. The method of claim 1 wherein said superabrasive particles comprise diamond.

4. The method of claim 1 wherein said binder is a vitrified ceramic material.

5. The method of claim 1 wherein said sacrificial member comprises a stainless steel alloy.

6. The method of claim 5 wherein said stainless steel alloy is chosen from the group consisting of an AM355 alloy and an A286 alloy.

7. A method for conditioning a grinding wheel, comprising the steps of:

providing a grinding wheel comprising a plurality of superabrasive particles dispersed in an abradable binder, said grinding wheel including at least one cutting surface for contacting a workpiece made of a selected first material;

truing said grinding wheel by rotating said grinding wheel while moving said cutting surface against a truing device such that said cutting surface is shaped into a preselected profile; and rotating said grinding wheel while moving said cutting surface against a sacrificial member comprising a stainless steel alloy chosen from the group consisting of an AM355 alloy and an A286 alloy, so that said binder is worn down, thereby creating a plurality of spaces between said superabrasive particles at said cutting surface.

8. The method of claim 7 wherein said superabrasive particles comprise cubic boron nitride.

9. The method of claim 7 wherein said superabrasive particles comprise diamond.

10. The method of claim 7 wherein said binder is a vitrified ceramic material.

11. A method for forming a feature in a workpiece, comprising:

providing a grinding wheel comprising a plurality of superabrasive particles dispersed in an abradable binder, said grinding wheel including at least one cutting surface for contacting a workpiece made of a selected first material;

truing said grinding wheel by rotating said grinding wheel while moving said cutting surface against a truing device such that said cutting surface is shaped into a preselected profile;

conditioning said grinding wheel by rotating said grinding wheel while moving said cutting surface against a sacrificial member made from a second selected material similar to said first selected material, wherein localized overheating of said sacrificial member occurs until said grinding wheel is adequately conditioned;

continuing said step of conditioning said grinding wheel until substantially all localized overheating of said sacrificial member is absent; and; and rotating said grinding wheel while moving said cutting surface against a workpiece such that a feature is formed in said workpiece without localized overheating of said workpiece.

12. The method of claim 11 wherein said superabrasive particles comprise cubic boron nitride.

13. The method of claim 11 wherein said superabrasive particles comprise diamond.

14. The method of claim 11 wherein said binder is a vitrified ceramic material.

15. The method of claim 11 wherein said second material is the same as said first material.

16. The method of claim 15 wherein said first and second material are chosen from the group consisting of an AM355 alloy and an A286 alloy.

17. The method of claim 11, wherein said step of conditioning said grinding wheel comprises:

providing a grinding apparatus comprising:

a grinding machine for receiving said grinding wheel;

a holding fixture for holding said sacrificial member;

means for moving said holding fixture relative to said grinding machine; and a controller for controlling said means for moving said fixture;

using said moving means to position said cutting surface in a preselected alignment relative to said sacrificial member;

rotating said grinding wheel and contacting said cutting surface and said sacrificial member to form a first cut in said sacrificial member;

separating said cutting surface and said sacrificial member;

repeating said steps of positioning said cutting surface, contacting said cutting surface and said member, and separating said cutting surface and said sacrificial member to form subsequent cuts in said sacrificial member created.

* * * * *

UNITED STATES PATENT AND TRADEMARK OFFICE

CERTIFICATE OF CORRECTION

PATENT NO. : 6,981,909 B2
DATED : January 3, 2006
INVENTOR(S) : Burgess, Gregory Mark It is certified that error appears in the above-identified patent and that said Letters Patent is hereby corrected as shown below:

Column 5,
Line 40, delete "; and" at end of sentence.

Signed and Sealed this

Twenty-eighth Day of March, 2006

JON W. DUDAS
*Director of the United States Patent and Trademark Office*